United States Patent [19]

Muncheryan

[11] 4,028,882

[45] June 14, 1977

[54] AWAKENING SYSTEM WITH MEANS ADAPTED TO RELAX TENSE MUSCLES

[76] Inventor: Hrand M. Muncheryan, 1735 N. Morningside St., Orange, Calif. 92667

[22] Filed: Feb. 19, 1976

[21] Appl. No.: 659,323

[52] U.S. Cl. ..... 58/152 B; 340/279; 340/331

[51] Int. Cl.[2] ..... G04B 47/00; G04C 23/12

[58] Field of Search ..... 58/19 R, 38 R, 38 A, 58/39, 152 B; 340/279, 283, 331

[56] References Cited

UNITED STATES PATENTS

| | | | |
|---|---|---|---|
| 900,293 | 10/1908 | Metz | 58/152 B |
| 924,127 | 6/1909 | Arms | 58/152 B |
| 2,460,133 | 1/1949 | La Pedus | 58/152 B |
| 2,496,373 | 2/1950 | Belich | 58/19 R |
| 2,561,481 | 7/1951 | Rody | 58/152 B |
| 2,580,598 | 1/1952 | Rody | 58/152 B |
| 2,923,122 | 2/1960 | Inman | 58/152 B X |

*Primary Examiner*—Stanley J. Witkowski

[57] ABSTRACT

An electronic system for awakening especially deaf persons and for relaxing and soothing tired and aching muscles of persons who frequently develop body tiredness from overwork or due to some organic illness is described. The systems comprises an electric timer unit for setting a desired time of the day when a sleeper intends to be awakened, and a pulsative resonator unit connected to said timer unit through an electric cord and is positioned, during use thereof, under the sleeper's pillow. When the set time of the day arrives, the timer unit automatically triggers the pulsative resonator unit, which causes a repeated vibratory action under the pillow and awakens the sleeper. The system is provided with a double-throw switch within a dual electric circuit therein whereby the repeatedly occurring vibratory pulsations produced in one of the circuits therein can be altered to one of continuous vibratory pulsations for application in the means for relaxing of tired or aching bodily muscles and thereby soothing the body.

21 Claims, 12 Drawing Figures

AWAKENING SYSTEM WITH MEANS ADAPTED TO RELAX TENSE MUSCLES

The present invention is related to a device for awakening a sleeper as well as relaxing the body muscles of persons who have frequent neck aches, shoulder aches, and general tiredness. The system is particularly concerned with the awakening of deaf persons who are generally unable to hear the sound or a buzzer or bell provided on all conventional alarm clocks.

BACKGROUND OF THE INVENTION

At the present time, the available awakening devices are usually incorporated in alarm clocks during manufacture thereof. Such available devices consist of either buzzers, bells, or other sound-producing means whereby a sleeper is awakened by the sound thereof. Such sound-producing devices for awakening are particularly intended for persons with normal hearing senses, thus unless the sleeper hears the alarm from the clock he cannot wake up by the manner intended. Furthermore, when two or more persons are sleeping in the same room, as in school dormitories, health or mental institutions, or certain homes, the sound from the clock alarm is not desirable because the sound will awaken other sleeping persons in the same room and possibly in other rooms when the bedroom doors are open, as usually they are, in a home. There has been occasions when a sleeper in a room containing other sleepers has hidden the alarm clock under his pillow so that he only can hear the sound of the alarm; however, such a procedure has not been completely satisfactory because by the time the clock is removed from underneath the pillow and the alarm stopped, sufficient time is elapsed between the removal of the clock and stopping the alarm as to awaken other people therein. The method is also cumbersome and annoying to the person using the clock under such conditions for awakening him.

A blind person as well as a normal person can be awakened by the use of conventional methods using alarm clocks. However, the same condition that prevails as for a normal person also prevails with blind person who happens to be sleeping in the same room with others. Furthermore, these methods of awakening are useless to a deaf person, since he cannot hear and be awakened by an acoustic means.

Other methods, such as the use of a high-intensity light projected on a sleeping person's face or on the ceiling having a reflective surface, such as a smooth white paint, have also been tried and found to be useless schemes because if a sleeper is not facing the light, which may be projecting, for example, from the left side of the sleeper and said sleeper may be sleeping on his right side or on his face, thus making the procedure or the method undesirable because unless the light is incident on the eyelids of the sleeper it will have no effect on the sleeper. The same condition is also true with a sleeping deaf person because of the same reasoning as stated.

It is thus seen that these earlier awakening devices or methods are not absolutely dependable, and consequently a device or system has been necessitated which will awaken a person, whether deaf, blind, or normal, without any limitation of conditions as imposed by the present methods. Consequently, the present invention has been created and developed to elimiate the disadvantages imposed by the present methods of awakening a sleeper. The present invention is reasonably simple in construction but is unique and effective in its method of operation. Furthermore, the system is adapted to be converted by a flick of a switch thereon into a relaxing and soothing device; the circuits to perform these functions have already been incorporated in the system. Also, the user of the latter mode of operation is not necessarily a sleeper but physically tired people, senior citizens having some form of bodily aches, tense muscles due to their sedentary conditions or age, and pain in muscles due to some type of organic illness can use the device to their advantage for these conditions or for awakening pusposes, or sickroom signalling for help from others, as will be understood from a review of the description in the specification.

The conversion of the device from one mode of operation, such as awakening a sleeper, to another mode of operation, such as relaxing and soothing a person with tired and aching muscles, enhances the system a double-function duty and makes it a useful, efficient, and positive-acting device. In addition, in another mode of operation using an illuminating lamp the device functions for signalling by a sick or bedridden person to others in the household to administer medicine or other necessities of life preservation.

SUMMARY OF THE INVENTION

The present invention is related to my recently patented invention entitled ALARM SYSTEM FOR SIGNALLING FOR EMERGENCY HELP, U.S. Pat. No. 3,911,425, issued to me on Oct. 7, 1975. The principal difference residing between the two inventions is that the patented device is constructed for use in a household as well as on the front entrance of an industrial building, bank, home, or similar establishments to alert others that some type of criminal act is in progress within the home, plant, shop, bank building, or the like. That device alerts others by producing a visual and acoustic (sound) signals, whereas the present device has been constructed to alert the user of the device and no one else. Although the present invention utilizes certain principles of the patented invention, the creation of sound is tabooed, and to that end it can be considered a modified species of the patented invention elaborated and refined in the present application. It is also evident that other persons in the immediate surrounding are definitely immune to the effects produced on a sleeper, or one relaxing his tired muscles; this is one of the most essential differentiating characteristics of the present system. In addition, the present system must and will awaken the sleeping person using it in a quiet manner and without disturbing other nearby persons, as well as being adaptable to the conversion into a relaxing and soothing device.

To achieve the awakening function, a principal object of the invention is to provide a means for producing interrupted pulsations in a unit adapted to be placed at a suitable location adjacent a person's body (preferably under his pillow) to stimulate the sleeping person's nerve center in a mild yet effective manner to cause the rousing of the person from his sleep.

A further object of the invention is to provide a timing mechanism which can be set to a predetermined time of the day so that at the relapse thereof said mechanism will trigger a current flow into a companion device electrically connected thereto for producing vibratory pulsations therein.

A still further object of the invention is to separate the pulsation producing device from the timing mechanism unit through a long electric cord so that the pulsation producing unit is completely isolated from the timing mechanism unit, thus eliminating any cumbersome assembly of mechanism from being placed under the pillow of a sleeper to awaken him.

Another object of the invention is the provision of a jack-and-plug means by which a connection is made between the unit containing the timing mechanism and the unit containing the pulsation-forming device, whereby when the pulsation-forming unit (the resonator, to be called hereinafter) is not in use it can be unplugged from the jack on the timing mechanism unit so that the timing mechanism can be used as an ordinary clock minus its alarm-producing section, which is eliminated in this invention.

One other object of the invention is the provision of a pulsation-forming means or the resonator which derives its vibratory pulsations not from a complex electronic circuit, a vibrating reed, buzzer, or bell device but by the creation therein a centrifual unbalance in the rotating axis of a miniature motor means disposed in the circuit thereof.

Another object of the invention is the provision of electrical isolation of the timing mechanism from the resonator, the former operating from a household alternating current and the latter operating from a group of battery cells incorporated in the system, although a commercial battery eliminator can be used in place of the battery cells.

One other object of the invention is to construct a system which is adapted to operate both as an awakening device and as a device for relaxing tired or aching body muscles and thereby soothing the body of the system user and, to achieve this purpose, pertinent electronic circuits have been incorporated in the system.

Other objects and advantages of the invention will become apparent from the specification taken in conjunction with the accompanying drawings, in which.

Figure 5:
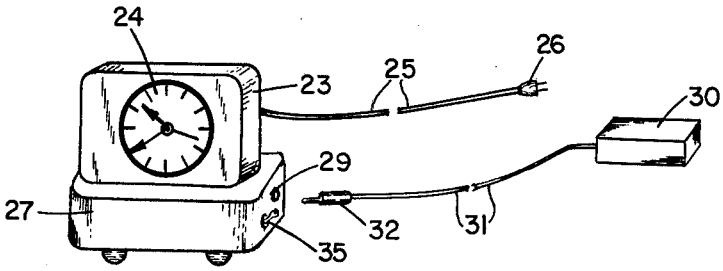
FIG. 5 is a modified embodiment of the invention, with the timer unit shown on the left containing the power supply, the resonator being isolated from the timer unit by means of a cord and jack-and-plug attachment means.
Figure 6:
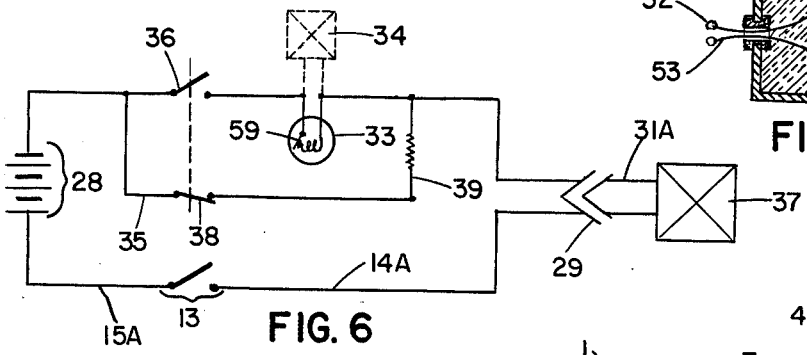

FIG. 6 illustrated the schematic circuit diagram of the system shown in FIG. 5.

Figure 7:
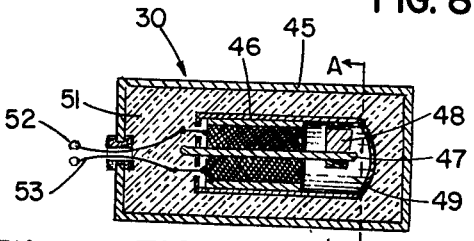

FIG. 7 is the long-axis cross-sectional view of the resonator unit shown in FIG. 5.

Figure 8:
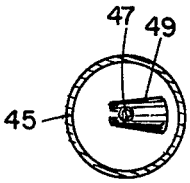

FIG. 8 is the top view of the radial cross section of the resonator unit taken at lines A—A′ shown in FIG. 7.

Figure 9:
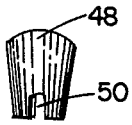

FIG. 9 is the centrifugally unbalance-forming mass provided at the terminal portion of the motor axis of the resonator unit shown in FIG. 7.

Figure 10:
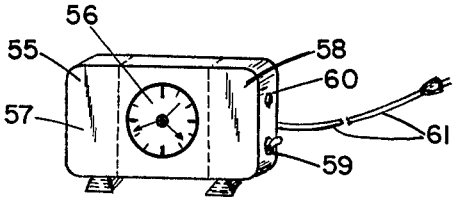

FIG. 10 is the general view of another modified form of the timer unit into which plugs the resonator shown in FIG. 5, the broken lines on the timer unit indicating the compartments within the unit that contain the power supply for the resonator.

Figure 1:
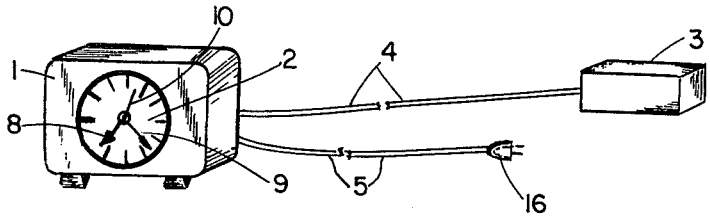
FIG. 1 is a general view of the system comprising the timing-mechanism unit and the resonator.
Figure 11:
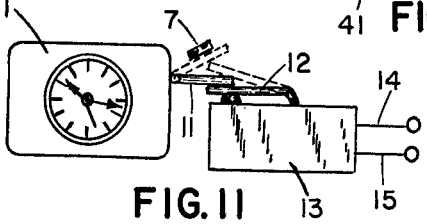

FIG. 11 illustrates the manner the timing mechanism is utilized to close the circuit to the resonator; this arrangement is the same for all the embodiments shown in FIGS. 1, 5, and 10.

Figure 12:
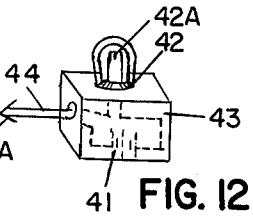

FIG. 12 is a lamp with a stand which contains a power supply, and is adapted to be connected to the timer units shown in FIGS. 5 and 10.

DETAILED DESCRIPTION OF THE INVENTION

Referring to the drawings, numeral 1 in FIG. 1 designates the housing of the timing mechanism, numeral 2 designates the timer time display, and numeral 3 is the pulsative resonator which causes the awakening action in a sleeping person and is connected to the current-triggering mechanism (see FIG. 11) within the timer housing 1. The electric cord 4 connects the resonator 3 to said current-triggering mechanism and cord 5 transmits to the timing mechanism a current from a 115-volt alternating-current source, such as that available in a household current source.

Figure 2:
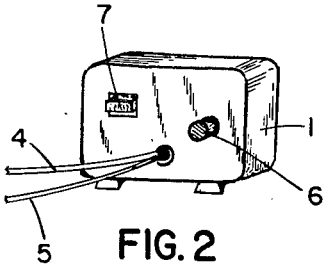
FIG. 2 is the rear view of the timing-mechanism unit or timer unit showing the time-setting knob, the resonator trigger release at the upper left side, and the partial views of the electric cords extending therefrom.

FIG. 2 is the rear view of the timer housing 1 and contains thereon a knob 6 used for setting a predetermined time of the day for the operation of resonator 3, and lever 7 controls the release of the current-switching mechanism 13, shown in FIG. 11. When the lever 7 (FIG. 2) is in the in-position the current triggering mechanism 13 is locked so that the current trigger 11 cannot be operated; when the lever 7 is pulled outwards as far as it will go it releases the current trigger 11, whereby when the predetermined set time arrives current trigger depresses the lever 12 and closes the current through current-switching mechanism 13. This latter action permits a current to be transmitted to the resonator 3 through the electric cord 4, for operation of said resonator 3.

On the front face of the timer housing 1 is the timer time display 2 which indicates the time of the day and contains an hour hand 8, minute hand 9, and the time-setting hand 10, which is set by means of the knob 6. Within the housing 1 and connected to the timing mechanism of the timer unit is a spring-biased lever 11, shown in FIG. 1. Lever 11 is the current trigger and when tripped by the timing mechanism on lapsing of the set time of the day it moves downwards in the diagram shown in FIG. 11 and depresses lever 12 to close the circuit, as shown by the solid lines. The broken lines show the positions of the levers 11 and 12 in a quiescent state of the switch 13, i.e., when the swtich 13 is open. As stated earlier, the current-triggering mechanism comprising the parts 11, 12, and 13, and the output leads 14 and 15 from switch 13 are the same in all the species shown in FIGS. 1, 5, and 10.

In the operation of the embodiment shown in FIG. 1, the plug 16 inserted into a household current outlet supplying a 115-volt AC current. This action starts the operation of the timing mechanism. The resonator, provided with a 6- to 8-foot long cord, is placed under the sleeper's pillow at any convenient area thereof, preferably about the mid-point of the pillow. If the sleeper desires to wake up at a given time, he sets the timer hand 10 to that specific time on the face 2 of the timer unit, using the knob 6. The knob is also adapted to move the hands 8 and 9 for adjusting them precisely to the time of the day. As a last step, lever 7 is pulled all the way out as far as it will go; this action releases the locking action of the lever 7 on the resonator trigger shown in FIG. 11, thereby when the set time arrives the trigger switch closes the circuit in 13, which action permits a current to flow therethrough into the resonator 3 through cord 4. Upon waking up, the user pushes the lever 7 all the way in; this action opens the resonator circuit and thereby prevents unnecessary battery drain.

Figure 3:
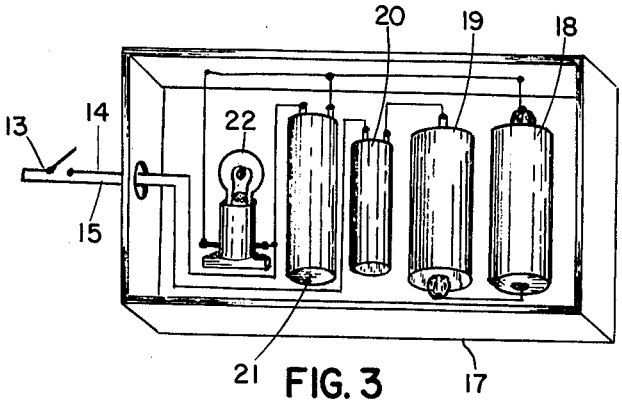
FIG. 3 shows the terminal parts of one species of the resonator and their arrangements therein, with the cover thereof removed.
Figure 4:
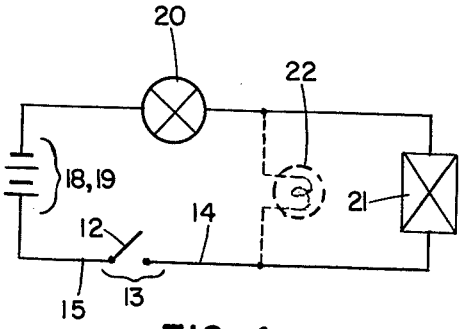
FIG. 4 is the schematic circuit diagram of the system shown in FIG. 1.

In the embodiment shown in FIG. 3, the cover of the resonator 3 housing 17 is removed to show inside structures, which comprise electric batteries 18 and 19 (the number of batteries being exemplary), a current interrupter 20, a resonative pulsing member 21, and a lamp 22. A resistor of equivalent resistance of the lamp 22 may be substituted for lamp 22, if desired. The resonative pulsing member or pulser 21 is integrally attached to housing 17 by means of any suitable attaching means, such as an epoxy compound, so that any vibratory motion thereof is directly transmitted to said housing 17, causing it to resonate in unison with pulser 21. The batteries 18 and 19 are connected in series with each other and with current interrupter 20 in series relation thereto. Switch 13, shown in FIGS. 3 and 4, represents the trigger mechanism of switch 13 shown in FIG. 11. The pulser 21 could be a vibrator means or the motor-operated means marked by 46 shown in FIG. 7. Also, instead of the use of batteries 18 and 19, a battery eliminator of equal voltage and current can be used in the system. The battery eliminator draws a current from the same 115-volt AC source, as the timing mechanism, reduces the voltage and puts out a rectified direct current, the same as the batteries.

It will be noted that the lamp 22 is represented in broken lines in FIG. 4. The reason for this lies in the fact that if a conventional vibrator is used in the pulser 21, the latter will not start when the current-triggering switch 13 is closed, because the current interrupter 20, being in series with the pulser 21, has a current contact gap therein and a fine filament in adjacent relation to a theremosenstive element which opens and closes the main circuit through the pulser 21, which also has a contact gap in its normal factory-made structure. Accordingly, then, a light source or an equivalent resistor must be inserted between the current interrupter 20 and the batteries (18 and 19), since an incandescent lamp will carry therethrough a continuous current (no contact gap); this condition will permit the pulser (vibrator) 21 to operate. However, when the pulser is constructed in the manner shown in FIG. 7 (to be described presently), a lamp or a resistor is not needed, since the motor resonating means 46 shown in FIG. 7 draws a continuous current, thus permitting the operation of the current interrupter 20.

FIG. 5 represent another modified form of the invention and is the preferred embodiment of the invention. In the figure, the housing 23 includes therein the timer 24, which is the same structurally as that shown in FIG. 1 and operates in the same manner. An electric cord 25 transmits a 115-volt AC current from a household current outlet through the plug 26 when connected thereto. A second housing 27 located at the inferior aspect of housing 23 supports the housing 23 and includes therein either all the component parts shown in FIG. 3 minus the resonator 30 The inclusion of the power supply (batteries) 28 or battery eliminator 28A and the current interrupter (such as 21 or 34) in housing 27 offers the added advantage of making the resonator 30 smaller in size and lighter in weight; furthermore, such an arrangement isolates the resonating means 21 (FIG. 3) from the batteries, the current interrupter, and the lamp, if there be one. The isolation of the pulser or resonating means 21 (30, or 37) increases the operational lives of the component parts, since no vibration will be transmitted thereto, although in FIG. 3 all component parts except the pulser 21 are embedded in a shock-proof polyester or rubber material, not shown in the figure for clarity.

The housing 27 is permanently attached to or is integral with the housing 23, depending on the manner it is desired to construct the housings. The two housings can be molded in one piece, since they are made of a plastic material, such as bakelite, although metal or any other suitable material can be used in their construction. The timer 24 contains the same type of switching means 13 with analogous structure thereto. Wires 14A and 15A are analogous to the wires 14 and 15 of switch means 13, and pass through an interconnecting aperture, formed in the bottom wall of housing 23 and the top wall of housing 27, into the chamber within housing 27 and connect the resonator 30 through 6- to 8-foot long electric cord 31 and plug member 32 to the circuit of the component parts shown in FIG. 6.

The circuit, shown in FIG. 6, can be operated in two modes of operation: one mode of operation puts out a recurrently pulsating (repeatedly interrupted) current from the circuit thereof, by using either the flashing lamp 33 or current interrupter 34 (either one is installed during manufacture) and closing the switch 35 section 36; the second mode of operation puts out a continuous current by bypassing the lamp 33 or the current interrupter 34, by closing the switch 35 section 38 and passing the current through the current bypass or jumper 39 to jack 29. In the diagram in FIG. 6, the section 36 of switch 35 is open, as example. The current interrupter 34 is a thermosensitive means having therein a thermosensitive element and a resistant filament which carries the initially small current passing therethrough for heating said element which closes the circuit, permitting a larger current to pass therethrough. In the first mode of operation, the flashing lamp 33 operates as a current interrupter, since the resonator 37 is the type shown in FIG. 7; this mode of operation is used for awakening a sleeping person when used thereby, and the second and continuous mode of operation is used for relaxing and soothing tired and aching muscles, both of the modes using the resonator 37. The electric cord 31A is analogous to cord 31 shown in FIG. 5.

The double-throw switch 35 may be either a toggle switch, as shown in FIG. 5, or a push-on push-off type double-throw pushbutton switch. The reason for double-throw arrangement is that if one section, such as section 36, is open the other section, section 38, is closed and vice versa. However, section 38 of switch 35 has another function; it joins the power supply batteries 28 or battery eliminator 28A to the power supply 41 of a lamp 42 (FIG. 12), thus increasing the power to the lamp 42. The lamp 42 is provided with a housing 43, used as a lamp base as well as a compartment for holding the power supply or the batteries 41. The output of the power supply passes through lamp 42 and the double-wire electric cord 44 and its plug 44A to the jack 29, when the resonator 30 is not employed.

Lamp 42 is adapted to operate in two modes; a continuous mode for illumination, and an interrupted or flashing mode for signalling. In the first mode of operation, the current from battery 28 joins the current from battery 41, through section 38 of switch 35 and the jumper means 39. When section 36 of switch 35 is closed, the current from battery 28 passes through the flashing lamp 33 and jack 29 into housing 43, wherein it is joined by battery 41 to supply an interrupted current to lamp 42, which then flashes intermittently, about 60 times per minute. A shield 42A, which rotates at its base section, can be used to direct the illumination from the lamp 42 to any desired direction, thus preventing other persons that may be sleeping in the same room from being affected by the light from the lamp, i.e., they are not disturbed.

FIG. 7 shows the longitudinal or long-axis sectional view of the resonator 30, shown in FIG. 5. The resonator 30 comprises an elongated housing 45, of a nominal size, for example, 3 inches long by 2 inches wide by 1 inch deep, although it can be made of any other suitable size and configuration. The housing 45 can be made of any suitable material such as plastic or metal, plastic being preferable for its appearance, weight, and low cost, and various colored plastics or painted metal housing may be used as desired. The housing 45 includes therein principally a miniature motor 46 operable from a power source or batteries contained in housing 27 or in compartments 57 and 58. The motor 46 is provided with a shaft 47, at the terminal portion of which is a "load" or mass 48 located in the chamber portion 49 of the motor 46. The mass 48 may either be welded to shaft 47 or press-fitted at the slot 50 over the shaft 47.

Since, the mass 48 extends radially to the shaft 47, it produces an operational unbalance, in a centrifugal direction, in the shaft 47 at high rotational speeds and the unbalance increases as the shaft rotational speed increases. Furthermore, in order to magnify the unbalance at any speed, the shaft 47 is slightly bent at the base of the mass 48, the bend is so slight that it has not been shown in the figure, for sake of clarity. The weight of the mass 48 together with the slight bend in the shaft 47 causes a combined centrifugal force so great at the speeds the motor 46 is driven that the whole structure including the housing 45 vibrates in a plane at right angles to the axis of the housing 45. When a pulsating or interrupted current is transmitted into the motor 46 from, for example, the circuit of FIG. 6, the direction of vibration caused by the interrupted current in resonator 30 or 37, a resultant vibrating force, is produced which causes the motor housing 45 to resonate with a pulsative motion. The motor 46 is potted in housing 45 so that the whole mass of the resonator vibrates pulsatively as one unit; the potting material is shown as numeral 51 in housing 45. The two wires 52 and 53 emerging from housing 46 are shown schematically and are analogous to the electric cord 31 shown in FIG. 5.

In the operation of the device shown in FIG. 5, the timer 24 is set to the desired time by the manner described for the device shown in FIG. 1, the resonator 30 (or 37) is placed under the sleeper's pillow, and the plug 32 is inserted into the jack 29. With the timer 24 plugged into a 115-volt household current, when the set time of the day arrives the switch 13 closes (as described hereinabove) and the resonator 30 begins to resonate pulsatively. If a current interrupter, such as the interrupter 34, has been used in the circuit of FIG. 6, then the resonator 30 starts immediately to vibrate; but, if the flashlamp, such as lamp 33, is used, then the resonator 30 starts to vibrate continuously for a few second (about 5 to 8 second) before it begins to resonate pulsatively. The reason for a small delay is that it takes a few seconds for the thermosensitive element 54 of lamp 33 to heat up and deflect, thus closing the main circuit current through the lamp 33. When the element 54 cools it deflect in the opposite direction to open the circuit.

In FIG. 10, another modification of the invention is shown. This unit operates in exactly the same manner as that shown in FIG. 5, with the exception that the housing 55 is made of *one piece* and is elongated to make room for the timer 56 and for the circuit component parts shown in FIG. 6. Two chambers are provided in housing 55, one on each side of the timer 56, and are designated at the areas marked by broken lines as at 57 and 58, respectively. As in the embodiment shown in FIG. 5, the housing 55 is provided in the wall thereof with a double-throw switch means 59 having the same function as switch 35, shown in FIG. 5. A jack 60, similar to jack 29, located adjacent the switch 59, is adapted to receive the plug 32 of resonator 30 (or 37), or plug 44A of lamp 42. The jack is also adapted to receive any one of the plug shown.

The disclosure of the invention described herein represents the preferred embodiments of the invention; however, variations thereof, in the form, construction, and arrangement of the various component parts thereof and the modified applications of the invention are possible without departing from the spirit and scope of the appended claims.

I claim:

1. An awakening system with means adapted to relax tense muscles, comprising: a first electrical unit and a second electrical unit connected theretogether through an elongated connecting means; said first electrical unit comprising a housing having therein a timing mechanism provided with a movable lever means actuated thereby, said timing mechanism receiving a current for operation thereof from an external current source, a current-switching means disposed in said housing and mechanically connected to said movable lever means for actuation thereby and electrically connected to said elongated connecting means; said timing mechanism having means adapted to set the timing of said timing mechanism to any predetermined time of the day; said second electrical unit having a housing containing therein an electrical circuit and means for producing resonant pulsations disposed in said electrical circuit and intimately connected to said housing; an electric source disposed within the electric circuit of said means for producing resonant pulsations and connected thereto for providing an energization current transmitted thereto through said current-switching means, said means for producing resonant pulsations comprising, in the circuit thereof, a vibratory means and a current interrupter means; a current bypass means is connected in the circuit of said means for producing resonant pulsations in electrically parallel relation to said current interrupter means; said current-switching means actuated by said movable lever means is provided with means to electrically connect and disconnect the current to said means for producing resonant pulsations in the housing of said second electrical unit; a current control means having a current-channeling means is disposed in one wall of the housing of said first electrical unit and connected in the electrical circuit of said means for producing resonant pulsations and is adapted to switch the current supplied thereto from one of interrupted mode of operation through said current interrupter means to one of continuous mode of operation by disconnecting the current in said current interrupter means and channeling said current through said current bypass means into said means for producing resonant pulsations; said means for producing resonant pulsations is adapted to be placed under the pillow of a sleeper desirous of waking up at a predetermined time of the day, whereby when said current-switching means located within the housing of said timing mechanism is actuated by the movable lever means of said timing mechanism at the predetermined time of the day to which said timing mechanism has been set to actuate said movable lever means, said means for producing resonant pulsations receives a current from the electric source, disposed within the circuit thereof, through said current interrupter means and produces repeated resonant pulsations which are transmitted through the pillow to the sleeper, and, when said current control means is switched in a manner to electrically isolate said current interrupter means from the circuit of said means for producing resonant pulsations, said latter means receives through said current bypass means a continuous current transmitted thereto from said electric source in the circuit thereof and resonants with a steady, recurring vibratory pulsations, which when transmitted to the tired muscles of a person produces in the muscles microcontractions and relaxations and thereby soothes the muscles thereof to a relaxed physical condition.

2. An awakening system with means adapted to relax tense muscles as defined in claim 1, wherein said movable lever means in mechanical connection with said current-switching means is constructed with a spring action therein and adapted to become displaced by said timing mechanism with respect thereto during quiescent operation thereof and to be released thereby to return to its normal position when the set time of the day arrives, said motion of said movable lever means is utilized thereby to cause mechanical movement of said current-switching means connected thereto and to thereby close said current-switching means to pass a current therethrough.

3. An awakening system with means adapted to relax tense muscles as defined in claim 1, wherein said second electrical unit having a housing is provided therein with a chamber, said chamber containing therein an electrical circuit, a vibratory mechanism connected to said electrical circuit and rigidly attached to said housing; said electrical circuit having a source of current therein connected to said vibratory mechanism for energization thereof through the electric circuit therein, and a current interrupter means disposed in said electrical circuit and connected in series relation with said source of current and said vibratory mechanism; said electrical circuit having an electrical cord in series connection with said source of current, said vibratory mechanism, and said current interrupter means, and extending outwardly from the housing of said second electrical unit and terminating in a current control means located in the housing of the first electrical unit and in adjacent relation to the timing mechanism in said housing.

4. An awakening system with means adapted to relax tense muscles as described in claim 3, wherein said electrical cord extending from said second electrical unit and terminating in a current control means located in the housing of the first electrical unit in adjacent relation to the timing mechanism is permanently attached to said current control means, which is a single-throw open-circuit switch means.

5. An awakening system with means adapted to relax tense muscles as described in claim 3, wherein said current interrupter means is a miniature electric lamp containing therein a thermosensitive means adapted to periodically interrupt the current therethrough.

6. An awakening system with means adapted to relax tense muscles as defined in claim 4, wherein said single-throw open-circuit switch means has an elongated lever means adapted to close said single-throw open-circuit switch means upon pressing thereof on said elongated lever means; said elongated lever means being in intimate contact with a movable lever means provided on the timing mechanism disposed within the first electrical unit and operable by the timing mechanism therein, whereby when said movable lever means presses upon said elongated lever means during operation of said timing mechanism, said elongated lever means closes the circuit in said single-throw open-circuit switch means, and when said movable lever means moves back from said elongated lever means said single-throw open-circuit switch means opens the circuit therethrough.

7. An awakening system with means adapted to relax tired muscles as descried in claim 1, wherein said first electrical unit comprises a housing with two compartments therein, an upper compartment and a lower compartment, said upper compartment containing therein a timing mechanism and said lower compartment having therein a current source, and a dualfunction electrical circuit means connected to said current source to receive an energization current therefrom; said dual-function electrical circuit means having two sections adapted to operate in two different modes, and a current means provided with dual switching sections disposed in said dual-function electrical circuit means, with each switching section corresponding to one of the two modes of operation and receiving a current from said current source to transmit it into the corresponding circuit section of said dual-function electrical circuit means, for producing in said circuit section the corresponding mode of operation thereof.

8. An awakening system with means adapted to relax tired muscles as described in claim 7, wherein said dual-function electrical circuit means contains in the circuit thereof an electric battery, a current interrupter means, a double-throw switch means, and a single-throw switch means, all of which being connected theretogether in electrically series relation; said single-throw switch means being disposed adjacent a lever means of the timing mechanism positioned in the upper compartment in said first electrical unit and having an electrical cord extending therefrom through an aperture formed at the bottom section of said uper compartment to a jack disposed in the wall of the lower compartment of said first electrical unit.

9. An awakening system with means adapted to relax tired muscles as described in claim 1, wherein said means for producing resonant pulsations comprises a housing having therein an electric means provided with a rotating means, said rotating means having an axial means adapted to produce, when rotated, an unbalanced centrifugal force to create a radially directed vibratory motion of said electric means; said electric means having electric connections extending therefrom to the exterior of the housing thereof; an electric source disposed in the first electrical unit, said electrical source having a circuit with a section provided with means to produce a pulsating current therein and supplying said current to said electric means through the electric connections thereof for producing therein a vibratory motion, which combined with said radially directed vibrator motion of said electric means produces a resultant vibratory resonance in the housing of said electric means; said electric means together with the proximal ends of said electric connections thereof is potted in said housing, whereby the resultant resonative motion of said electric means is transmitted to the exterior of said housing through the potting material and the walls of said housing.

10. An awakening system with means adapted to relax tired muscles as described in claim 9, wheren said rotating means is an elongated shaft extending axially of said electric means and terminating at one end thereof in a mass of metal disposed radially thereof to produce an unbalance in the rotation of said elongated shaft, said elongated shaft having a bend adjacent the base of said mass of metal to magnify said unbalance in the rotation of said elongated shaft.

11. An awakening system with means adapted to relax tired muscles as described in claim 1, said means for producing resonant pulsations is an electric vibrator receiving for operation thereof a current from the electric source disposed in the first electrical unit and connected to said electric vibrator; said electric vibrator having a housing, with said electric vibrator potted therein for producing a vibratory resonance of said housing by the vibration produced by said electric vibrator at right angles to the long axis of said housing and transmitting thereto, through the potting material therein, a pulsative vibratory motion to produce a pulsative resonance thereof.

12. An awakening system with means adapted to relax tired muscles as described in claim 1, wherein said timing mechanism has an elongated housing and a time display means positioned in one wall of said housing and facing to the exterior thereof; two chambers are formed within said housing, one of each side of said timing mechanism, and a current supply means disposed within each of said two chambers and electrically connected theretogether to form a single-power source, a current interrupter disposed in the circuit of said single-power source in electrically series relation thereto; the cricuit of said single-power source being divided into two circuit sections, and a double-throw switch means disposed in one wall of said housing and operable externally thereto is connected to each of said two circuit sections, permitting said double-throw switch means to channel a current from said single-power source into either one of said circuit sections; one of said circuit sections, having in series connection thereof, said current interrupter for producing a recurrent current flow therethrough, and the other circuit section having a jumper means adapted to receive a current from said single-power source to furnish a continuous current through said circuit section, and a current control means disposed in the circuit of said single-power source to turn on and turn off a current therefrom into each of said circuit sections; said timing mechanism having a lever adapted to be moved by said timing mechanism in accordance with the setting of said timing mechanism for a predetermined time of the day, and said current control means being positioned in contiguous relation to said lever and operable thereby; an open-circuit jack means disposed in the wall of said housing in adjacent relation to said double-throw switch means and connected electrically in series with the circuit of said single-power source; and, the means for producing resonant pulsations is provided with an electric cord extending therefrom and terminating in a plug means adapted to be inserted into said open-circuit jack means to receive therefrom a current from either one of the two circuit sections in said single-power source for actuation of said means for producing resonant pulsations.

13. An awakening system with means adapted to relax tense muscles as described in claim 12, wherein said two circuit sections connected to the single power source to receive current therefrom comprise a first circuit section and a second circuit section, and wherein said doublethrow switch means is provided with two electrical contact means, one of said electrical contact means being connected to said first circuit section and the other electrical contact means connected to said second circuit section, whereby if one electrical contact is open the other electrical contact means is closed; said double-throw switch means being connected to said single-power source and receiving current therefrom; said first circuit section having in the circuit thereof a current interrupter for producing a pulsating current output, and said second circuit section having a bypass means therein to receive a current from said singlepower source through one of said contact means to supply a continuous current output; said means for producing resonant pulsations being connected to both of said circuit sections and receiving current individually therefrom; a motor means having an elongated rotary means having a terminal portion provided with a metal weight to cause an unbalance in the rotation thereof and thereby to produce a vibratory motion in means for producing resonant pulsations when said motor means receives a current from said second circuit section, said vibratory motion thereof being utilized for relaxing tense muscles; and, when said motor means receives a pulsating current from said first circuit section the pulsations of said current produce an electric force in said motor means which results, together with said vibratory motion, in a pulsative resonance of the housing of said electric means; said pulsative resonance of the housing produces the awakening action in a sleeping person.

14. An awakening system with means adapted to relax tense muscles as described in claim 12, wherein said means for producing pulsations and connected to said open-circuit jack means is replaced by an electric lamp means having an electric cord extending therefrom provided at the distal end thereof with a plug means which is adapted to be inserted into said open-circuit jack means in the housing of the timing mechanism to receive from said open-circuit jack means, when closed, either an interrupted current from one of the two circuit sections, disposed in the circuit of the single-power source, containing the current interrupter or a continuous current from the second of said two circuit sections; said continuous current produces a continuous light from said lamp means for illumination, and said interrupted current produces a flashing light for signalling for help from available persons in the area; said lamp means having a rotatable shield thereon with an open side to direct therefrom an illumination to a restricted-size area.

15. An awakening system with means adapted to relax tense muscles as described in claim 14, wherein said electric lamp means is provided with a base formed in a housing configuration, a source of current is disposed within said housing and connected to said lamp means in an open-circuit relation thereto, electric connectig wires extending from said source of current externally to said housing to a distanace of 6 to 8 feet and terminating in a plug means adapted to fit into the open-circuit jack means located on the housing of the timing mechanism, said source of current being coupled by the single-power source in said housing of the timing mechanism, thereby to intensify the current transmitted to said lamp means for increased illumination therefrom; the circuit to said electric lamp means is closed by a single-throw switch means disposed in the circuit of said single-power source in adjacent relation to said timing mechanism and mechanically connected to a switch release means provided on said timing mechanism and operated thereby by manual manipulation of said switch release means in said timing mechanism.

16. The awakening system as defined in claim 12, wherein said system comprises a first electrical unit and a second electrical unit having an electric connector electrically connected to said first electrical unit and being detachable therefrom through said electric connector; said first electrical unit is provided therein with an electric circuit with a current source connected in the circuit thereof; said electric circuit having means to automatically open and close said circuit repeatedly whereby a constantly interrupted current is supplied therefrom to said second electrical unit; said second electrical unit is provided with means to receive said constantly interrupted current for producing a vibratory motion therein and to transmit said vibratory motion to the housing thereof, said housing being adapted to be placed under a sleeper's pillow for transmitting therethrough a pulsative vibration to said sleeper to arouse him from his sleep.

17. The system adapted to relax tense muscles as described in claim 12, said system comprises a first and a second electric units, the first of said electrical units is provided with an electrical circuit connected to a current source therein and adapted to supply a continuous current to the second of said electrical units through an elongated electric connecting means provided therebetween, said continuous current supplied to the second of said electrical units energizes the means for producing resonant pulsations disposed in the second electrical unit and produces a continuous vibratory motion within the housing thereof, said means for producing resonant pulsations being intimately attached to the housing of said second electrical unit, whereby said continuous vibratory motion is transmitted to said housing to vibrate with a continuous vibratory motion at right angles thereto, and when said housing with continuous vibration is positioned in abutment with the tense muscles of the body it produces a soothing effect in the body muscles by microcontractions and relaxations thereof.

18. An awakening system with means adapted to relax tense muscles as described in claim 1, wherein said first electrical unit is provided in the housing thereof with an electric circuit having an electric current source disposed therein for supplying a current thereto, a current control means disposed in said electric circuit to regulate the current thereto from said electric current source, a current interrupter means connected in said electric circuit to produce a pulsative current therethrough, and a timer means mechanically connected to said current control means to select the time for permitting a current to flow from said electric current source through said current control means into said electric circuit having the current interrupter; and, an electric connecting means for electrically coupling said first electrical unit to the second electrical unit for transmitting thereinto a pulsative current, said second electrical unit having means therein to receive said pulsative current for producing a vibratory motion therein.

19. An awakening system with means adapted to relax tense muscles as described in claim 1, wherein said means for producing resonant pulsations comprises an elongated housing having therein a plurality of electric batteries connected theretogether in series relation, a vibrator connected to said electric batteries to receive an energizing current therefrom and intimately attached to said elongated housing, a light flasher electrically coupled in series with said electric batteries and said vibrator, and an electric lamp disposed in the circuit of said vibrator in electrically parallel relation thereto; an elongated double-wire electric cord with one end thereof being in electrical connection in series relation to the electric circuit formed by said electric batteries, said vibrator, said flasher, and said electric lamp, and the opposite end thereof extending into the housing of the first electrical unit and terminating in an open-circuit switch means; a timing mechanism disposed within the housing of said first electrical unit and having a time trigger means adapted to operate at a time of the day set by said electrical timing mechanism; said open-circuit switch means having means mechanically coupled to said time trigger means and operated thereby for closure of said open-circuit switch means to transmit therethrough a current from said electric batteries to energize said flasher, said vibrator, and said electric lamp in said elongated housing for producing a vibratory motion of said elongated housing.

20. An awakening system with means adapted to relax tense muscles as described in claim 1, wherein said electric source is a power supply means receiving a 115-volt alternating current from said external current source, transmitted into the housing of said first electrical unit; said power supply means is adapted to produce a rectified direct current of a voltage equivalent to that furnished by said electric source, for energizing the electric circuit of the means for producing resonant pulsations.

21. An awakening system with means adapted to relax tense muscles as described in claim 1, wherein said first electrical unit comprises a housing containing therein a current-supplying means having an electric source with a current control means connected thereto, a timing mechanism means mechanically coupled to said current control means to limit the operation of said current-supplying means to a predetermined time of the day, said current-supplying means having a double-channel transmission section, one of the channels of said double-channel current transmission section having therein a flasher means for producing a pulsative current therein and the other channel of said double-channel current transmission section being provided with means adapted to pass therethrough a continuous current supplied by said electric source; the second electrical unit comprises a lamp with a base section having a housing with a current source disposed therein to provide a current to said lamp for energization thereof, an elongated electrical connecting means with one end thereof connected to said current source and the other end to said current control means in said first electrical unit to receive through said current control means and through one channel of said double-channel current transmission section either a pulsative current, from the channel having said flasher means, or a continuous current from the channel containing a jumper means therein, to produce respectively a rising and falling flash illumination in said lamp or a continuous high-intensity illumination therein, by the combined electrical energy of said electric source in said first electrical unit and said current source in the housing of the base section of said lamp.

* * * * *